US008275166B2

(12) United States Patent
Wu

(10) Patent No.: US 8,275,166 B2
(45) Date of Patent: Sep. 25, 2012

(54) HEADPHONE OF CONVENIENT ASSEMBLY AND PACKAGE

(75) Inventor: Hsien Yu Wu, Chungli (TW)

(73) Assignee: Multi-Direction Co., Ltd., Chungli, Taoyuan County (TW)

( * ) Notice: Subject to any disclaimer, the term of this patent is extended or adjusted under 35 U.S.C. 154(b) by 369 days.

(21) Appl. No.: 12/718,949

(22) Filed: Mar. 5, 2010

(65) Prior Publication Data

US 2011/0216932 A1 Sep. 8, 2011

(51) Int. Cl.
*H04R 25/00* (2006.01)

(52) U.S. Cl. ..... 381/380; 381/328; 381/384

(58) Field of Classification Search ..... 381/309, 381/312, 322, 328, 370, 371, 376, 380, 382, 381/384; 181/129, 130, 135
See application file for complete search history.

(56) References Cited

U.S. PATENT DOCUMENTS 3,623,571 A * 11/1971 French ..... 181/135
5,887,070 A * 3/1999 Iseberg et al. ..... 381/380
2011/0044487 A1* 2/2011 Nault ..... 381/380

* cited by examiner

*Primary Examiner* — Huyen D Le
(74) *Attorney, Agent, or Firm* — Chun-Ming Shih

(57) ABSTRACT

A headphone of convenient assembly and package includes a first earpiece and a second earpiece. The first earpiece has a tubular first casing and the first casing includes a first ear plug. The second earpiece has a tubular second casing and the second casing includes a second ear plug. The first casing has a clasping portion at an end opposite to the first ear plug. The second casing has a clasping recess at an end opposite to the second ear plug for receiving the clasping portion. Therefore, the first earpiece and the second earpiece can be assembled together into a tubular single piece, benefiting the first earpiece and the second earpiece for being packaged and carried, thus improving the convenience of the headphone.

2 Claims, 5 Drawing Sheets

HEADPHONE OF CONVENIENT ASSEMBLY AND PACKAGE

BACKGROUND

1. Technical Field

The present invention provides a headphone of convenient assembly and package, and relates to an earphone or a canalphone, more particularly to a clasping portion formed on a casing of an earpiece, and a clasping recess formed on a casing of another earpiece for receiving the clasping portion.

2. Description of the Related Art

Modern people always release themselves by music. For avoid disturbing others and isolating external noises when listening music, headphones are always used such that music can be heard directly without disturbing others and being interfered by external noises.

Conventional headphones include circumaural headphones, supra-aural headphones, earphones, canalphones and so on. The earphone includes a left earpiece and a right earpiece. Vocalization elements, i.e., ear plugs of the earpieces are arranged at the outer side of the ear canals for listening. The earphone is of compact, lightweight, simple manufacture and low cost, and can be packaged in pocket. The canalphone also includes a left earpiece and a right earpiece, and ear plugs of the earpieces are inserted into the ear canals for listening. The configuration and lightweight and compact characteristics of the canalphone are similar to the earphone, and the canalphone can either be packaged in the pocket. Therefore, earphone and canalphone had become the mainstream equipment of mobile phones, laptop computers, MP3s, MP4s, MP5s and other portable music players.

However, the left earpiece and the right earpiece of the conventional earphone and canalphone could not be assembled together, therefore, they are always scattered in bags or pockets when carried out. Because the left earpiece and the right earpiece could not be easily sorted together. Moreover, when the user applies one of them for listening music, the unused one is always scattered aside. Meanwhile, the line of the unused earpiece influences the movement of the user. Therefore, for users, the conventional headphones are inconvenient in package, carry and usage, and need to be further improved.

BRIEF SUMMARY

The present invention is to overcome the shortcomings that the earpieces of the conventional headphone could not be assembled together such that one of the earpieces is easily lost during package, carry and usage, and the line of unused earpiece is easy to influence the movement of the user.

In order to achieve the objective, the present invention provides a headphone of convenient assembly and package. The headphone includes a first earpiece and a second earpiece. The first earpiece has a first casing and a first ear plug is disposed at an end of the first casing. The second earpiece has a second casing and a second ear plug is disposed at an end of the second casing. The first casing has a clasping portion at an end opposite to the first ear plug. The second casing has a clasping recess at an end opposite to the second ear plug for receiving the clasping portion.

In the embodiment of the present invention, the clasping portion of the first earpiece is engaged in the clasping recess of the second earpiece, and the first earpiece and the second earpiece are assembled together into a single piece. Therefore, the first earpiece and the second earpiece are capable of being assembled together, which overcomes the shortcomings that one of the earpieces is easily lost during package, carry or usage, and the shortcomings that the line of the earpiece is easy to influence the movement of the user. Thus, the convenience in package, carry and usage of the headphone is improved.

The first casing and the second casing are tubular bodies of similar or symmetrical configurations, and the first casing and the second casing are assembled together into a tubular single piece.

An annular rib is formed on an outer wall of the clasping portion, at least one rib is formed on and circularly arranged along an inner wall of the clasping recess, for receiving the annular rib between a recess end of the clasping recess and the ribs.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

Figure 1:
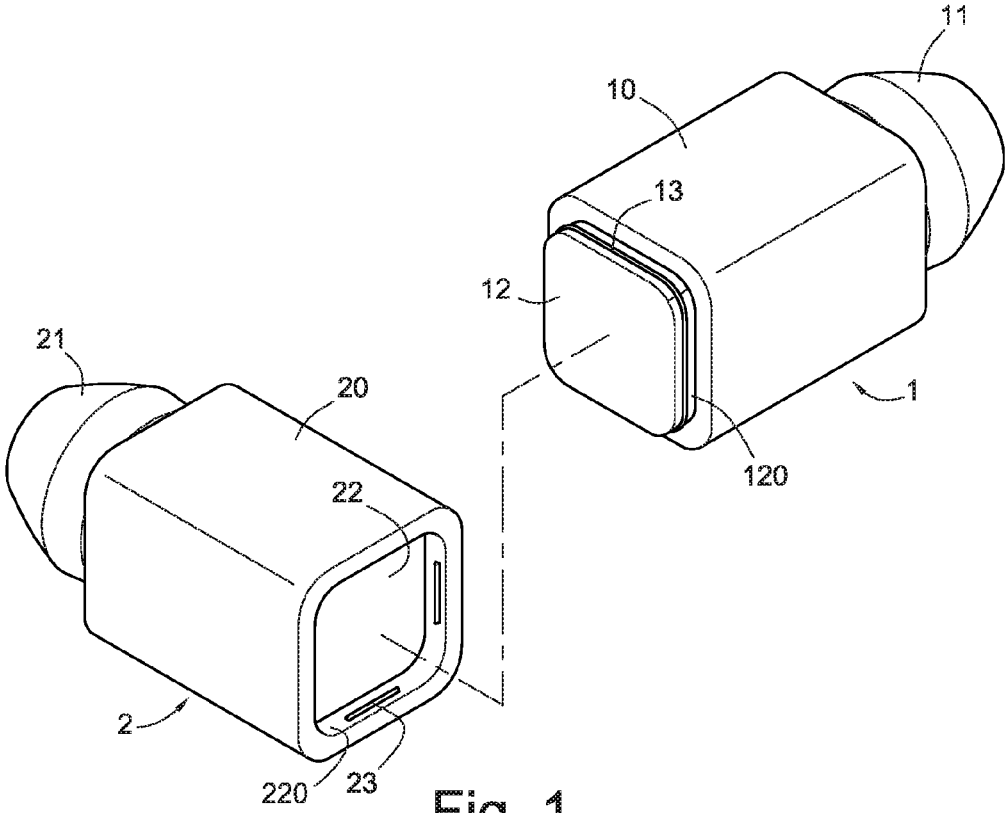
FIG. 1 is an exploded, three-dimensional view of an embodiment of the present invention.
Figure 2:
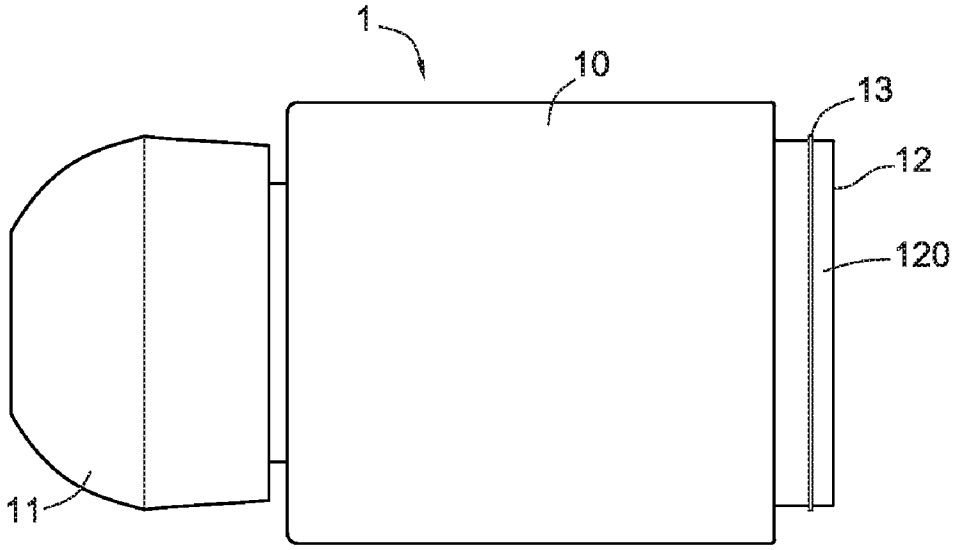
FIG. 2 is a top view of a first earpiece of FIG. 1.
Figure 3:
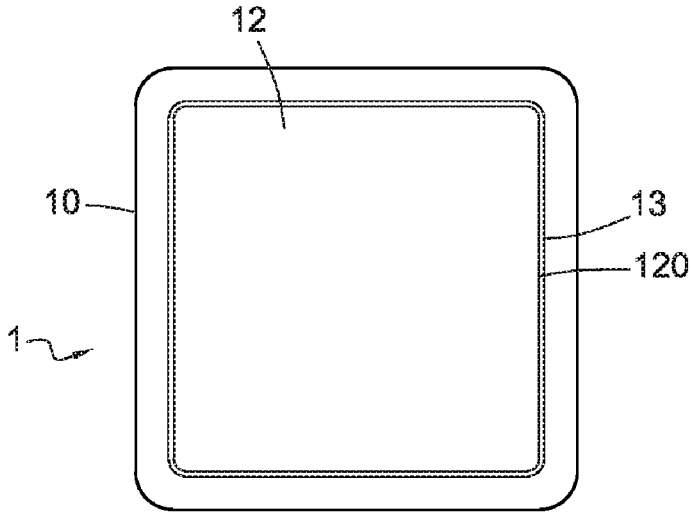
FIG. 3 is a side view of the first earpiece of FIG. 1.
Figure 4:
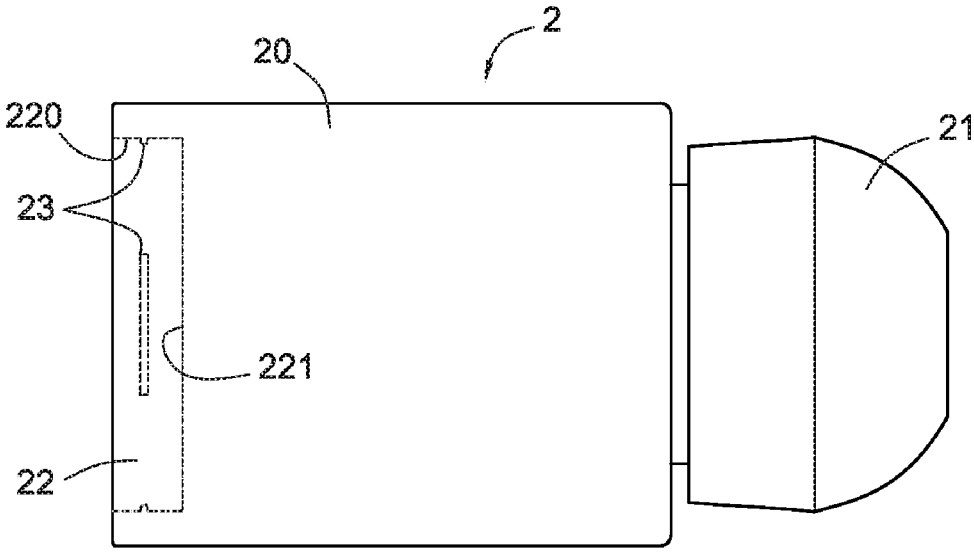
FIG. 4 is a top view of a second earpiece of FIG. 1.
Figure 5:
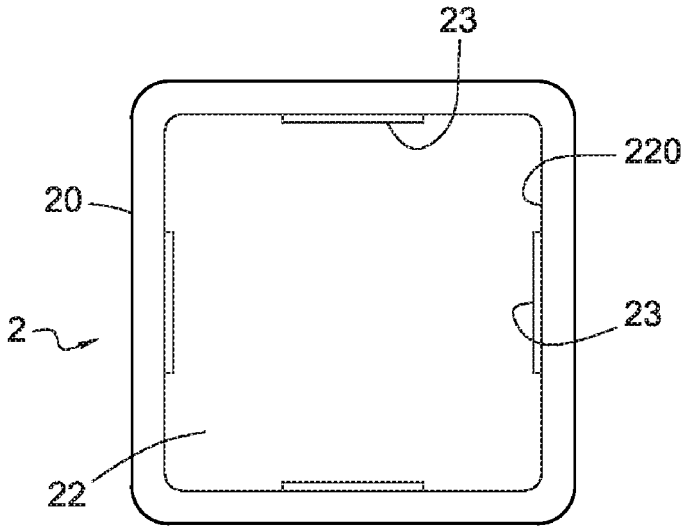
FIG. 5 is a side view of the second earpiece of FIG. 1.
Figure 6:
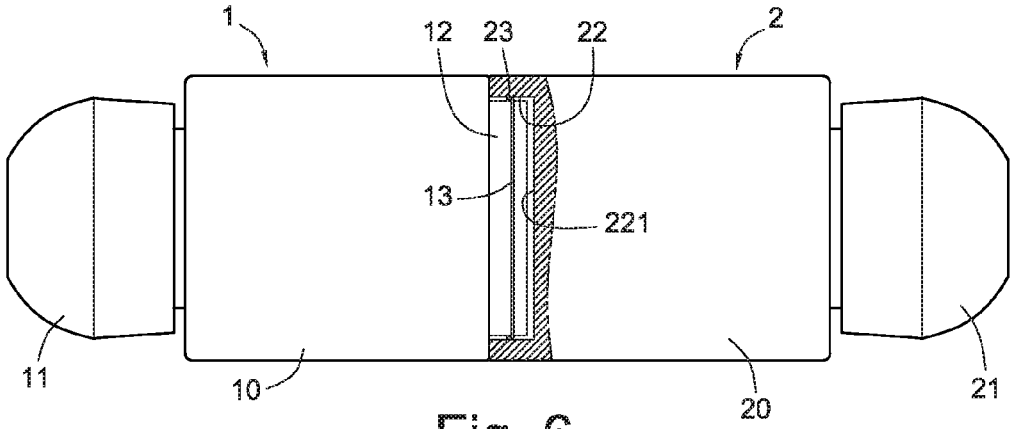
FIG. 6 is a partly cross-sectional view of an assembled state of the first earpiece and the second earpiece of FIG. 1.
Figure 7:
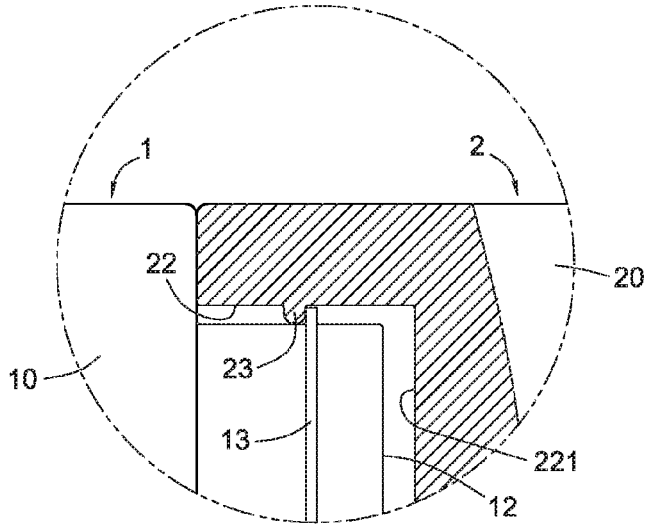
FIG. 7 is a partly enlarged view of FIG. 6.

FIG. 1 is an exploded, three-dimensional view of an embodiment of the present invention. FIGS. 2 to 5 illustrate a headphone of the present invention. The headphone of convenient assembly and package includes a first earpiece 1 and a second earpiece 2. The first earpiece 1 has a first casing 10 and a first ear plug 11 is disposed at an end of the first casing 10. The second earpiece 2 has a second casing 20 and a second ear plug 21 is disposed at an end of the second casing 20. The first casing 10 and the second casing 20 are tubular bodies of similar or symmetrical configurations. The profile of the tubular body may be circular or polygon. The first casing 10 has a clasping portion 12 at an end opposite to the first ear plug 11. In this embodiment, the clasping portion 12 is a rectangular block and an annular rib 13 is formed on an outer wall 120 of the clasping portion 12. The second casing 20 has a clasping recess 22 at an end opposite to the second ear plug 21 for receiving the clasping portion 12. In this embodiment, the clasping recess 22 is a rectangular recess for receiving the clasping block exactly. The second casing 20 further has a plurality of ribs 23 formed on and circularly arranged along an inner wall 220 of the clasping recess 22, for receiving the annular rib 13 between a recess end 221 of the clasping recess 22 and the ribs 23 (shown in FIGS. 6 and 7).

Figure 8:
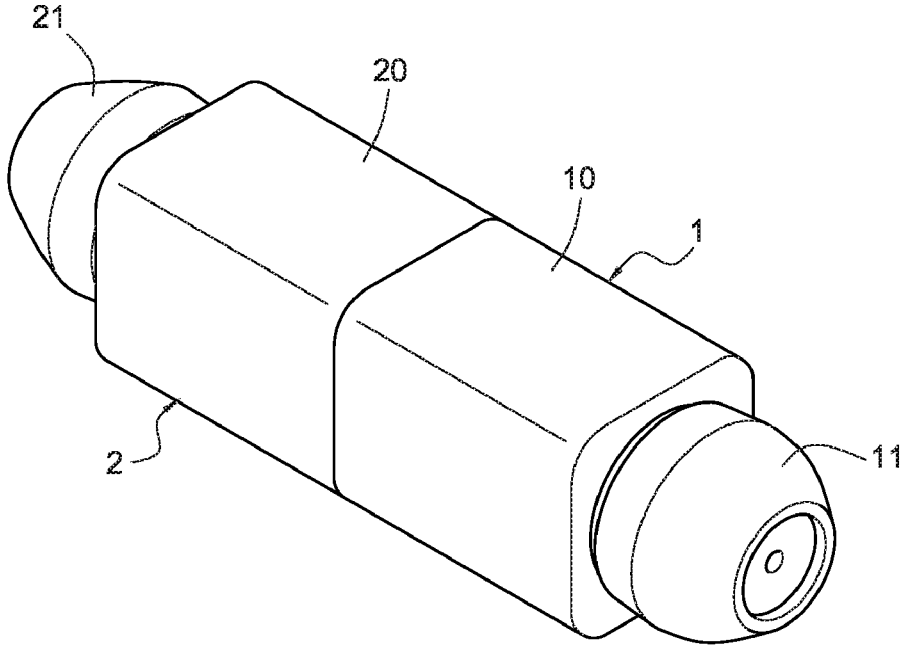
FIG. 8 is an assembled, three-dimensional view of the first earpiece and the second earpiece of FIG. 1.

By means of the forgoing structures, when the user wants to package or carry the headphone, the clasping portion 12 of the first earpiece 1 is directly inserted into the clasping recess 22 of the second earpiece 2 (referring to FIGS. 1, 6 and 7), and the annular rib 13 of the clasping portion 12 is engaged between the recess end 221 of the clasping recess 22 and the ribs 23. By means of the interference between the annular rib 13 and the ribs 23, the first casing 10 and the second casing 20 are assembled together into a tubular single piece (shown in FIG. 8), which is convenient for being hold. Therefore, the assembled first and second earpieces 1 and 2 can be packed in bags and pockets, convenient for being carried. When the user wants to use the headphone, the assembled first and second earpieces 1 and 2 are taken out together, preventing the troubles of finding the earpieces one by one. During usage, one of the assembled first and second earpieces 1 and 2 may be worn to the ear, preventing the troubles the line of the unused earpiece influences the movement of the user. Or else, the assembled first and second earpieces 1 and 2 may be exerted opposite force respectively to disengage the annular rib 13 from the recess end 221 of the clasping recess 22 and the ribs 23 such that the clasping portion 12 of the first earpiece 1 is disengaged from the clasping recess 22 of the second earpiece 2 for separating the first earpiece 1 and the second earpiece 2. Accordingly, the first earpiece 1 and the second earpiece 2 can be worn to the left ear and the right ear respectively.

For the forgoing reasons, the first earpiece 1 and the second earpiece 2 can be assembled together, thereby overcoming the shortcomings that one of the earpieces is easily lost during package, carry or usage, and the shortcomings that the line of the earpiece is easy to influence the movement of the user. Thus, the convenience in package, carry and usage of the headphone is improved.

Figure 9:
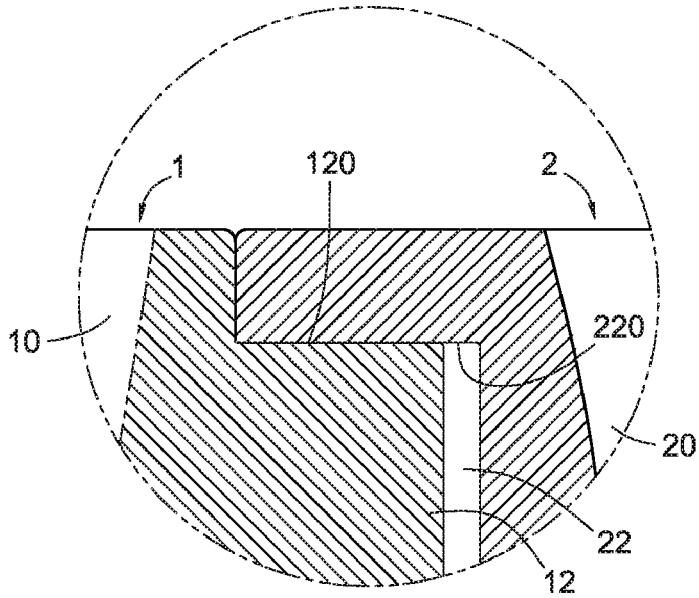
FIG. 9 is a cross-sectional view of an additional embodiment of FIG. 7.

Otherwise, in another embodiment of the present invention, the arrangement of the annular rib 13 is omitted from the clasping portion 12 and the arrangement of the ribs 23 are omitted from the clasping recess 22 (referring to FIG. 9), such that the outer wall 120 of the clasping portion 12 is intimately engaged in the inner wall 220 of the clasping recess 22, and the first casing 10 and the second casing 20 are assembled together into a tubular single piece. Other structures and implementation manner of this embodiment are similar to the forgoing embodiment and therefore are not redundantly described.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A headphone comprising:

a first earpiece having a first casing and a first ear plug disposed at an end of the first casing; and a second earpiece having a second casing and a second ear plug disposed at an end of the second casing;

wherein the first casing has a clasping portion at an end opposite to the first ear plug, the second casing has a clasping recess at an end opposite to the second ear plug for receiving the clasping portion, the clasping portion engages with the clasping recess for assembling the first casing and the second casing together into a single piece, and wherein an annular rib is formed on an outer wall of the clasping portion, at least one rib is formed on and circularly arranged along an inner wall of the clasping recess, for receiving the annular rib between a recess end of the clasping recess and the ribs.

2. The headphone as claimed in claim 1, wherein the first casing and the second casing are tubular bodies of similar or symmetrical configurations, and the first casing and the second casing are assembled together into a tubular single piece.

* * * * *